United States Patent [19]

Bowen et al.

[11] 4,028,212

[45] June 7, 1977

[54] SILVER RECOVERY APPARATUS

[76] Inventors: Woodrow L. Bowen, 175 W. Oakton St., Des Plaines, Ill. 60018; Harlan D. Moore, 809 Meadow Lane, Barrington, Ill. 60010

[22] Filed: June 14, 1976

[21] Appl. No.: 695,515

[52] U.S. Cl. ..... 204/272; 204/109; 204/234; 204/273; 204/275

[51] Int. Cl.[2] ..... C25C 1/20; C25C 7/00

[58] Field of Search ..... 204/109, 234, 237, 261, 204/263, 269, 272, 273, 275, 229; 259/4 AB, 4 A, 18, 11

[56] References Cited

UNITED STATES PATENTS

| | | | |
|---|---|---|---|
| 1,019,969 | 3/1912 | Lacroix | 204/275 X |
| 3,583,897 | 6/1971 | Fulweiler | 204/109 X |
| 3,715,299 | 2/1973 | Anderson et al. | 204/272 X |
| 3,728,244 | 4/1973 | Cooley | 204/275 X |
| 3,905,890 | 9/1975 | Minegishi | 204/273 X |
| 3,926,768 | 12/1975 | Burgess | 204/229 |

*Primary Examiner*—Arthur C. Prescott
*Attorney, Agent, or Firm*—Kenneth T. Snow

[57] ABSTRACT

A silver recovery apparatus for use in conjunction with photographic development systems acting to remove metallic silver from the hypo bath. The present device includes an electrolytic cell within a closed chamber through which the hypo bath is bypassed. The silver contaminated hypo solution is passed through the electrolytic chamber with a uniform velocity and is distributed uniformly over an extended cathode surface without any moving parts within the chamber. This uniformity of velocity and distribution causes maximum deposition of silver onto the cathode so that the hypo solution returning to the development and fixing process is considerably rejuvenated and continues to operate at high efficiency.

8 Claims, 9 Drawing Figures

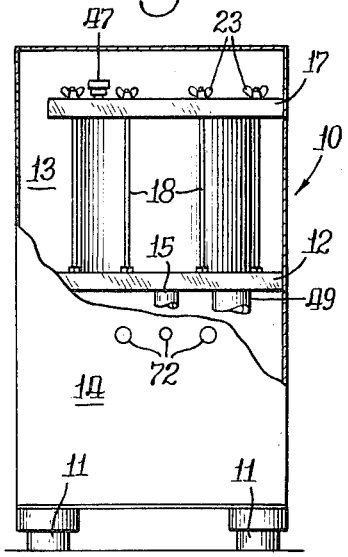
Fig. 1.
47
23
17
10
13
18
15
12
49
72
14
11
11
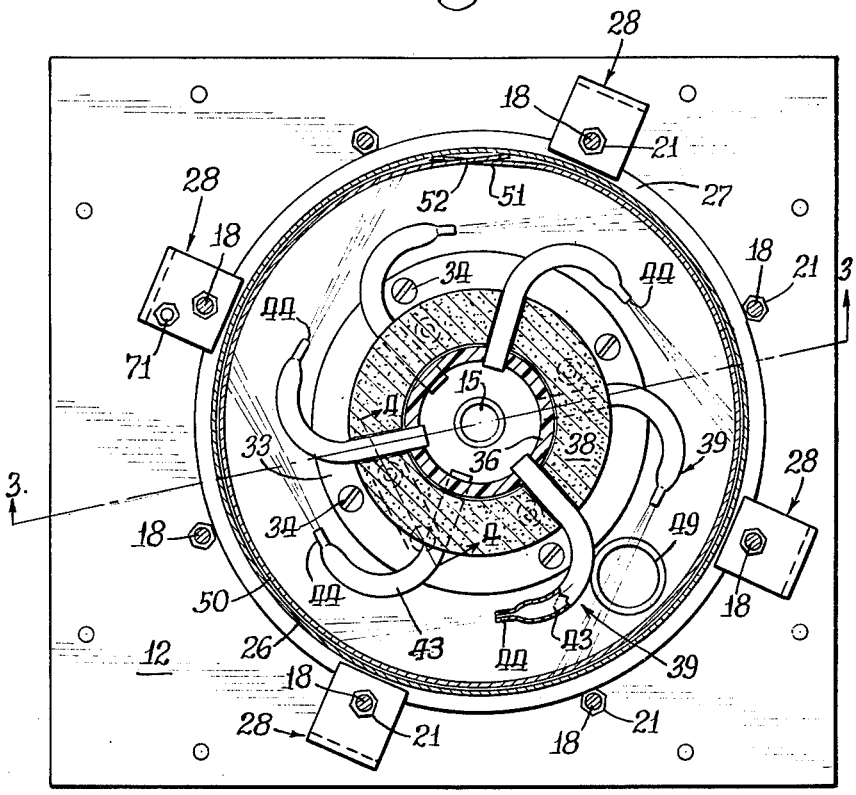
Fig. 2.
28
18
21
27
52
51
3
3.
12
15
36
38
39
33
50
26
43
49
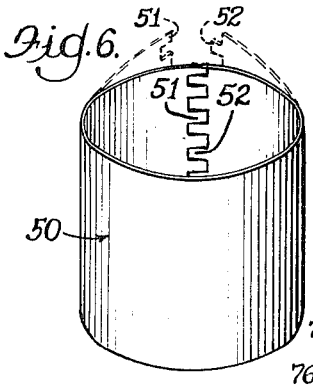
Fig. 6.
51
52
50
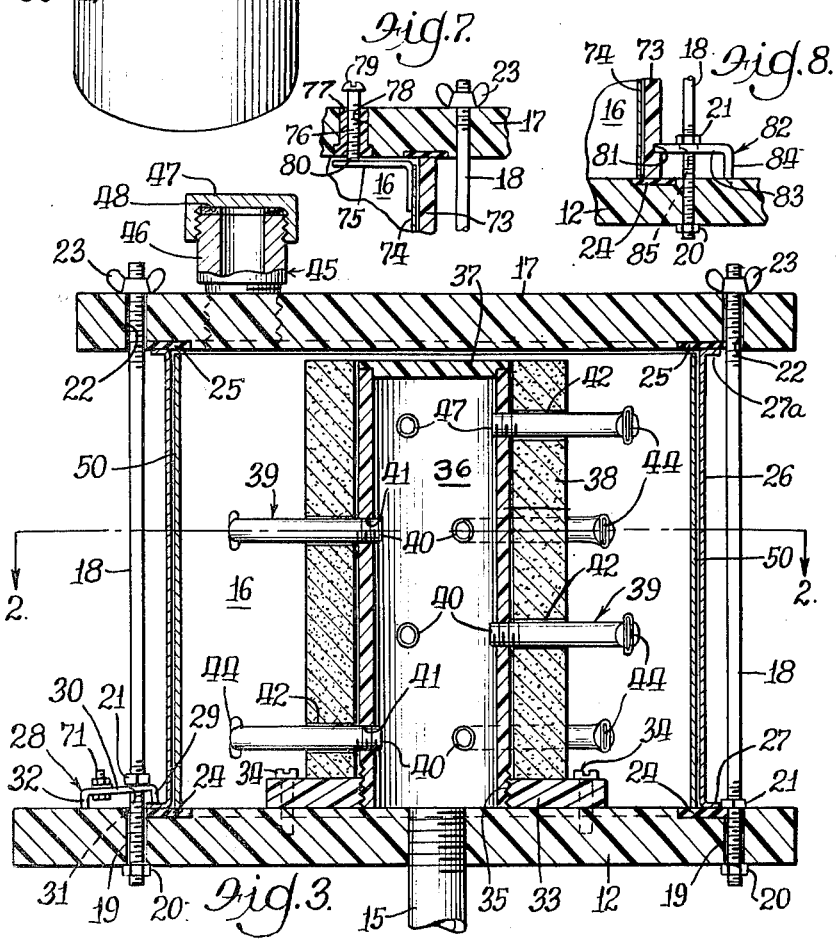
Fig. 3.
47
48
46
45
23
22
25
37
17
27a
50
39
36
38
26
18
16
2.
30
21
28
71
32
29
31
19
20
15
35
33
12
27
Fig. 7.
79
77
78
23
76
17
80
16
18
75
73
74
Fig. 8.
74
73
18
16
21
82
81
84
83
12
24
85
20
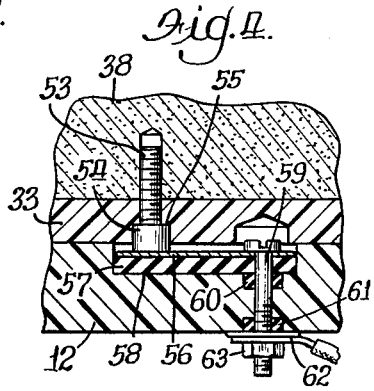
Fig. 4.
53
38
55
54
59
33
57
60
61
12
58
56
63
62
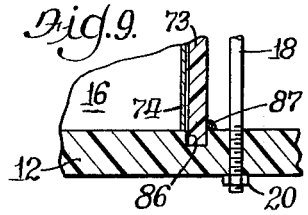
Fig. 9.
73
18
16
74
87
12
86
20
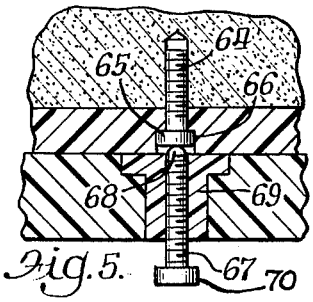
Fig. 5.
64
65
66
68
69
67
70

SILVER RECOVERY APPARATUS

BACKGROUND OF THE INVENTION

1. Field of the Invention

Development of X-ray films in hospitals and clinics is becoming substantially fully automated and the length of time the systems can operate continuously depend to a great extend on the degree of contamination of the hypo bath with silver. And, the great number of X-ray pictures taken and their large sizes means there is substantial silver contamination of the hypo bath very quickly unless some means is taken to alleviate this situation.

It is with this as a background that the present inventors have developed their silver removing device.

2. Description of the Prior Art

Silver removal or silver recovery devices and processes of many types have been tried and a number of them are in use. Agitation of the silver laden solutions have, as a rule, been accomplished by mechanical impellers or impeller like devices such as those shown in the following identified prior patents to:

- Hickman et al U.S. Pat. No. 1,954,316 APPARATUS FOR ELECTROPLATING SILVER FROM USED PHOTOGRAPHIC FIXING SOLUTIONS BY ELECTROLYSIS
- Hickman et al U.S. Pat. No. 1,959,531 APPARATUS FOR ELECTROPLATING SILVER FROM USED PHOTOGRAPHIC FIXING SOLUTIONS
- James et al U.S. Pat. No. 2,997,438 DEVICE FOR RECLAIMING SILVER FROM PHOTOGRAPHIC HYPO BATHS
- Wadsworth U.S. Pat. No. 3,196,095 METHOD OF REMOVING SOLIDS IN SOLUTION FROM A LIQUID
- Adams U.S. Pat. No. 3,342,718 APPARATUS FOR THE RECOVERY OF SILVER FROM USED PHOTOGRAPHIC FIXING SOLUTIONS BY ELECTROLYSIS
- Snow et al U.S. Pat. No. 3,477,926 ELECTROLYTIC PROCESS AND APPARATUS FOR RECOVERING METALS
- Cooley U.S. Pat. No. 3,551,317 ELECTROLYTIC APPARATUS FOR RECOVERING A METAL FROM A SOLUTION
- Fisher U.S. Pat. No. 3,560,366 AG-O-MAT SILVER RECOVERY UNIT
- Luck, Jr. U.S. Pat. No. 3,694,341 METAL RECOVERY DEVICE All of the above patents are concerned with the mechanical agitating of the hypo solution to attempt to further facilitate the electrolytic action and the depositing of metallic silver on the cathode.

The following prior patents are concerned with silver recovery from solutions but are primarily concerned with the sensing of the amount of silver deposited on the cathode to thereupon in turn control the amount of electrical current imposed on the system for gaining the most favorable rate of silver deposition.

- Engleman U.S. Pat. No. 3,524,805 SILVER RECOVERY SYSTEM
- Snook et al U.S. Pat. No. 3,551,318 AUTOMATIC CONTROL APPARATUS FOR SILVER RECOVERY In the present device applicants have no moving parts but rather accomplish their efficient electrolysis by an agitation of the solution by a series of strategically placed nozzles or jet tubes through which the silver contaminated hypo solution is pumped, thereby passing over a cylindrically shaped cathode in a uniform manner and with the aid of a flexible characteristic of at least the deposition surface of the cathode the deposited silver is easily stripped therefrom.

SUMMARY OF THE INVENTION

A principal object of the present invention is to provide a novel means for uniformly distributing a silver contaminated hypo solution in an electrolytic chamber in the area between a centrally located anode and an outer generally cylindrical cathode.

An important object of this invention is to provide the novel means of the preceding object and the further novel means for flowing the hypo solution in a generally uniform velocity over the cathode for effecting maximum deposition of the silver onto the cathode without any mechanical moving parts within that electrolytic chamber.

Another important object of this invention is to provide a novel arrangement of nozzles for a hypo solution entering an electrolytic chamber to thereupon distribute the solution over the full interior of the chamber.

Still another important object of this invention is to provide a novel combination of a stationary cylindrical anode having a plastic lined central passageway to receive incoming silver contaminated hypo solution bypassed from a complete photographic development system, and the anode having strategically arranged radial holes through its cylindrical wall with plastic jet tubes therein communicating with the central passageway and thereby permitting the hypo solution to flow out from the central passageway to the annular space between the anode and the surrounding cathode.

Another and further important object of this invention is to provide a device as set forth in the preceding object in which the plastic jet tubes in each of the radial holes in the anode are spaced apart vertically and arcuately to thereupon impart a circular flow of the hypo solution within the electrolytic chamber around the central anode and over the interior of the cathode on which the excess silver in the solution is deposited.

Another and still further important object of this invention is to provide a novel apparatus for efficiently taking out the unwanted silver from a hypo solution by electrolysis and causing the silver to be plated on a generally flexible, openably joined cylindrical electrical cathode by propelling the hypo solution within the chamber and without employing any mechanically moving parts within the electrolytic chamber for agitating the hypo solution.

Other and further important objects and advantages will become apparent from the disclosures in the accompanying drawings and the following description.

IN THE DRAWINGS

FIG. 1 is a front elevational view of the cabinet embodying the silver recovery apparatus of this invention. Portions of the outer covering have been broken away to show the interior.

FIG. 2 is an enlarged transverse sectional view of the device as taken on the line 2—2 of FIG. 3.

FIG. 3 is a vertical sectional view of the device taken on the line 3—3 of FIG. 2.

FIG. 4 is a detail sectional view taken on the line 4—4 of FIG. 2.

FIG. 5 is another detail sectional view similar to FIG. 4 but showing an alternative form of construction of the device.

FIG. 6 is a perspective view of the cathode liner of this invention.

FIG. 7 is a detail sectional view of a modified construction of the electrolytic chamber and the cathode of this invention.

FIG. 8 is a detail sectional view of an optional means for clamping a plastic cylindrical outer enclosure to the base plate of the electrolytic chamber.

FIG. 9 is a detail sectional view of another optional means for attaching the plastic cylindrical outer enclosure to the base plate of the electrolytic chamber.

AS SHOWN IN THE DRAWINGS

The reference numeral 10 indicates generally a housing or cabinet which embodies the silver recovery apparatus of this invention. The cabinet 10 is provided with floor engaging feet 11. About midway up on the box shaped cabinet 10 there is provided a horizontal separator plate 12 which is preferably made of a plastic material. The separator plate 12 defines an upper portion 13 of the cabinet and a lower portion 14. The lower portion houses the controls for the device of this invention and as shown in FIGS. 1 and 3 an inlet pipe 15 carries the hypo solution to be freed of metallic silver to an electrolytic chamber 16 housed within the upper portion 13 of the cabinet. The plate 12 forms the bottom of the electrolytic chamber 16. A top plate 17, also preferably made of a plastic material, constitutes the removable top of the chamber 16 and permits access to the silver after it has been separated from the solution by electrolysis. A plurality of vertically disposed arcuately spaced apart tie rods 18 are arranged and constructed to join the horizontal separator or bottom plate 12 and the top plate 17. Vertical holes 19 are provided in the plate 12 around a circular path thereon to receive the passage of the rods 18. Nuts 20 threadedly engage the lower ends of the rods 18 within the lower portion 14 of the cabinet 10. These nuts 20 abut the under surface of the cabinet dividing plate 12. Nuts 21 are threaded on the rods 18 and these are located on the top of the plate 12 and within the portion 13 of the cabinet. Some of the nuts 21 bear directly on the top surface of the plate 12. When both nuts 20 and 21 are drawn up tightly against the plate 12 therebetween the rods 18 stand upright to enable the top plate 17 to be removably mounted thereon. The top plate 17 is provided with a plurality of vertical holes arranged in a circular path therearound in the manner of the holes 19 in the plate 12 and in vertical alignment with those holes. The holes 22 are adapted to receive passage of the vertical rods 18. Hand operable wing nuts 23 are adapted to threadedly engage the tie rods 18 at their upper ends and when drawn up tightly bear on the top side of the top plate 17.

A circular resilient ring gasket or seal member 24 is inset in the upper surface of the separator or bottom plate 12 as best shown in FIG. 3. A similar circular ring gasket or seal 25 is inset in the under surface of the top plate 17. A relatively large diameter cylindrical electrical cathode 26 is preferably made of stainless steel and in this preferred embodiment constitutes the outer enclosure of the electrolytic chamber 16. It should of course be understood that this cathode or any of the alternative cathodes shown herein may be made of other electrically conductive materials such as other metals or metal coated non-conductive materials. Inasmuch as this member 26 performs the dual function of a cathode and a housing for the hypo solution to be treated it must be arranged in a sealing relationship with the plate 12 and the plate 17 which are the bottom and top respectively of the chamber 16. The lower edge of the cylindrical cathode 26 is provided with an outwardly extending annular flange or rim 27. The rim 27 is adapted to rest on the circular seal 24. The upper edge of the cylinder is provided with a similar outwardly extending annular rim **27*a* and this rim is sealingly engaged by the circular seal 25 in the lower surface of the top plate 17. Thus the cooperative engagement of the cylindrical member 26 with the gaskets 24 and 25 make for a liquid tight chamber 16**.

A plurality of U-shaped clamps 28 are employed to securely hold the cathode cylinder 26 in place. One leg 29 of the clamp 28 is adapted to bear on the circular flange or rim 27. The U-shaped clamps 28 are also equipped with a flat back 30, a hole 31 through the flat portion 30 to receive passage of a tie rod 18, and a spaced apart leg 32. The legs 29 and 32 are generally parallel one to the other. The leg 32 bears on the upper surface of the electrolytic chamber's bottom plate 12. Four such clamps 28 are shown to anchor the cathode cylinder in place. These are located at generally equally spaced intervals around the cylinder and at the point of a tie rod. Where each clamp is located the nuts 21 are disposed on the top of the clamp and when drawn up tightly the clamp is urged downwardly with the leg 29 in a gripping action on the cylinder flange rim 27 and at the same time the spaced apart leg 32 is pressed against the plate 12. This construction is shown in FIG. 3.

The electrolytic chamber 16 is provided with a plastic ring 33 located in a concentric manner over the inlet pipe 15 and sits directly on the top surface of the bottom plastic plate 12. The ring 33 is fastened in this position by screws 34. The inner circular surface of the ring 33 is threaded at 35 and is adapted to threadedly receive a vertically disposed plastic tube 36. The top of the tube 36 is sealingly closed by a top 37, also preferably made of a plastic material. The tube 36 and its top 37 thus define a centrally located chamber or passageway within the electrolytic chamber 16. It is this central passageway that directly receives all of the incoming electrolyte, which in this instance is a hypo solution as it enters the chamber through the inlet pipe 15.

A relatively small diameter cylindrical anode 38 is preferably made of a carbon material and may be of one piece construction or plural pieces as desired. The anode may be made of any suitable electrode material in the same manner as the cathode. The tubular anode 38 is adapted to be slid downwardly over the closed top plastic tube 36. The lower circular edge of the anode 38 is adapted to rest on the top surface of the plastic ring 33. The circular top of the anode terminates just below the plastic top 17.

A plurality of nozzles or jet tubes 39 are provided through the surface of the anode and are the means of uniformly distributing the entering electrolyte hypo solution in the electrolytic chamber. The hypo solution is thus spread evenly by the nozzles in the annular space defined between the anode and the cathode. The hypo electrolyte is jetted over the cathode to aid in the deposition or plating of the metallic silver on the cathode when a proper electrical potential is imposed across the anode and cathode of this electrolysis apparatus. Each of the nozzles or jet tubes is threaded at its inner end at 40 and those ends are threaded into similarly threaded apertures 41 disposed radially in the wall of the inner plastic tube 36 as best shown in FIGS. 2 and 3. To facilitate the assembly of the nozzles in the plastic core 36 there are enlarged holes 42 arranged radially in the walls of the carbon anode adjacent each of the threaded apertures 41 in the plastic tube 36. Further, each nozzle or jet tube is arcuately bent at substantially right angles as shown at 43. All of the bends 43 are in the same direction with their discharge ends lying in a circular path which is generally concentric with the centrally located anode and the outer cathode. Actually the bend is slightly greater than 90° and the bent ends 43 are curved so their discharge ends lie in a concentric circular path between the anode and the cathode. The ends of the nozzles or jet tubes are restricted as shown at 44 and these ends are formed by squeezing the tubes in a horizontal direction to form narrow vertically disposed slits. The construction is thus arranged so that incoming hypo solution to be treated does not contact the anode prior to its distribution between the anode and the cathode.

As best shown in FIG. 3 the nozzles or jet tubes 39 on each of four different horizontal levels in the chamber 16 are, as shown in FIG. 2, arcuately spaced apart approximately 120°. Also, the nozzles on alternate vertical levels are at the same arcuate position on the anode while the intermediate levels of nozzles are arcuately offset from the other nozzles by approximately 60°. There are thus two vertically spaced apart nozzles 39 every 60° around the circumference of the cylindrical anode.

An air vent 45 is provided in the top 17 of the closed electrolytic chamber 16. The vent member has a stationary base 46 which is threadedly engaged to the top 17. A cap 47 is removably attached by threading to the base 46. The cap 47 is thus adapted to close the top of the vent after air venting of the closed chamber 16 is completed. A gasket or sealing ring 48 is positioned between the base 46 and the cap 47 to enable the complete sealing of the electrolytic chamber 16 when the vent is closed.

A relatively large diameter discharge port in the form of a pipe 49 is provided in the divider or bottom plate 12 at a position between the anode and the cathode and horizontally spaced from the inlet 15. it should be understood that hypo solution bypassed from a photographic development system is admitted to the electrolytic chamber 16 through the incoming pipe 15 and when the excess metallic silver has been removed from the electrolyte solution, the solution is returned to the photographic development system through the pipe 49.

As best shown in FIGS. 3 and 6 there is disclosed a liner 50 for the cathode 26. The liner 50 is preferably made of stainless steel and has an inherent spring quality. This liner comprises a generally rectangularly shaped piece of stainless steel adapted to be rolled into a cylindrical shape. A first end of the liner is provided with a series of projecting teeth 51 and similarly the other or second end has a series of teeth 52 offset or intercalated with the teeth of the first end 51. When the liner 50 has its toothed ends 51 and 52 brought together the teeth are easily intermeshed to create its desired cylindrical shape. The diameter of the formed cylinder when the teeth are fully engaged is just slightly less than the diameter of the outer cathode cylinder 26. Thus the liner 50 held in its full tooth engaging state has a snug fit within the outer cylinder 26. The design of the liner is such that there is a constant tendency for the liner to expand or spread outwardly resulting in an opening of the tooth engagement thereby making good electrical contact of the liner with the cylinder 26. In this preferred embodiment it is the liner portion of the cathode which receives the deposition of the silver and when electrolysis has proceeded far enough to require removal of the deposited silver the top 17 of the electrolytic chamber 16 is removed by unscrewing the wing nuts 23. Once the top is removed the flexible liner 50 is raised out of the chamber and the silver taken off the liner. The openability and flexibility of the liner 50 contribute to the easy removal of the deposited silver. Following removal of the silver the liner is reformed into a cylinder and reinserted into the chamber 16 for resumption of the electrolytic process.

The electrolysis process requires that electrical energy be delivered to and across the anode and the cathode whereupon the liquid electrolyte is energized causing the breakdown of the chemical components of the electrolyte and a plating out of the freed metal positive ions on the negative cathode. In this case the silver is freed from the hypo solution and deposited on the cathode and its electrically integral liner 50.

The electrical connection to the anode is accomplished in the manner shown in either FIG. 4 or FIG. 5 of the drawings. In the embodiment of FIG. 4 a metal contact bolt 53 threadedly engages the bottom and extends up into the carbon anode so that when electrical energy is delivered to the bolt it insures that the anode receives that electrical energy. The bolt 53 has a head 54 which is partially recessed within a shouldered hole 55 in the plastic ring 33. A spring metal contact strip 56 has contact at one end thereof with the depending head 54 of the bolt 53. The strip 56 extends laterally over an elongated resilient cushion 57 which is disposed in a recess 58 so that it is inset in the top surface of the plate 12. The cushion 57 acts to urge the contact strip 56 into electrical contact with the bolt head 54. A headed bolt 59 passes through the other spaced apart end of the contact strip 56 with its threaded shank extending downwardly through the plate 12. Vertically spaced apart ring seals 60 and 61 encircle the bolt 59 within recesses in the plate 12. It is the seals 60 and 61 which together bar the escape of any of the electrolyte solution through the electrical contact means to the carbon anode. A wire connector 62 engages the lower end of the bolt 59 depending from the plate 12. A nut 63 threadedly engaging the lower end of the bolt 59 holds the wire 62 thereto. There is thus accomplished an electrical connection from an external source to the internally located anode 38 of this invention without any liquid leakage from the chamber in which electrolysis occurs.

FIG. 5 shows an alternative form of getting electricity to the anode 38. Here a bolt 64 is again threaded into the bottom of the anode 38 and has its head 65 disposed in a shouldered recess 66 in the under surface of the plastic ring 33. Another bolt 67 is provided with a rounded end 68 adapted to contact the underside of the head 65 of the bolt 64. A shouldered bushing 69 preferably made of an elastomeric material is mounted in the plate 12. It is through this bushing 69 that the bolt 67 passes to provide a contact for the incoming electrical energy. The lower end of the bolt 67 is provided with a head 70 to which electrical contact can be made to deliver such energy to the carbon anode 38. Again, in this embodiment, as in the embodiment of FIG. 4, there is no leakage of electrolyte liquid from the chamber 16 through the contact means because it is effectively sealed by the nature of the construction and its sealing elements around the contacting bolts.

As best shown in FIGS. 2 and 3 one of the cathode clamps 28 is provided with an electrical contact post 71. It is to this post 71 that electrical energy is delivered to the cathode 26 and its electrically integral liner 50.

The specific means for applying electrical potential to the anode and the cathode is housed within the lower portion 14 of the cabinet 10, but has not been shown. Knobs 72 are provided on the outer surface of the cabinet and are the means to turn the device on or off and to deliver more or less electrical energy to the anode and the cathode for flow through the liquid electrolyte within the chamber 16.

FIG. 7 shows an optional form of cathode construction. In this detail illustration the top plate 17 is shown with its inset gasket material 25. In this modified construction the outer cylindrical wall is not the cathode or even a part of the cathode but rather merely a plastic enclosure 73 to constitute the outer housing wall of the liquid tight chamber 16. Obviously the plastic outer cover 73 cannot act as the cathode and hence a cylindrical cathode 74 is disposed within the outer plastic cylinder 73. The cathode 74 is preferably made of stainless steel and can either be fixedly constructed as a cylinder or may be constructed as the previously described liner 50 wherein it could be openable for removal of the silver deposited thereon. With this modified construction the clamps 28 engaging the flanged bottom edge cannot be used as electrical connectors as the outer cylinder to which the clamps now engage is plastic. To provide for an electrical connection to the cathode an inwardly turned tab or contact spring 75 is provided at the upper end of the cylindrical metal cathode 74. It is this metal tab 75, which may be narrow, wide, or even continuous around the top of the cylinder 74, that is used to gain electrical contact to the cathode from a position outside the chamber 16. it should be understood the contact spring 75 may be integral with the cathode material or may be fastened thereto such as by welding to make it electrically integral. A metal bolt 76 is adapted to theradedly engage an elastomeric shouldered bushing 77 which is mounted in a shouldered aperture 78 in the top plate 17. A suitable bushing material could be that known as Teflon and made by the E. I. Du Pont Company. The electrically conductive bolt 76 is provided with a head 79 and a rounded lower end 80. When the bolt 76 is screwed down the end 80 makes electrical contact with the tab 75. Thus a lead wire to the bolt head 79 permits electrical energy to be imposed on the cathode 74 of this modified form of the invention. Obviously, the principle of operation of the modification is the same as the device as set forth in the previously described drawing figures.

FIG. 8 shows a modified detail construction for the sealing closure of the bottom of the electrolytic chamber 16 when the plastic outer housing 73 is employed. An annular groove 81 is provided in the outer surface of the cylindrical plastic enclosure 73 at a position spaced slightly above the bottom and disposed parallel to the bottom. The flat bottom of the plastic housing rests on the elastomeric ring 24 which is recessed or inset in the bottom plate 12. Of course when the wing nuts 23 disposed above the top plate 17 are drawn up tightly there is provided a downward force on the plastic cylinder causing it to press against the sealing ring 24 with the result that the chamber 16 is liquid tight. However, when the top 17 is removed to take out accumulated silver there is only the weight of the plastic cylinder pressing down on the seal and it is conceivable the assembly could leak at that point unless other provisions were made to hold the plastic in sealing engagement with the ring 24. An L-shaped clamp 82 is substituted for the U-shaped clamp 28. The modified clamp 82 has a horizontal leg 83 which is adapted to engage the groove 81. A vertical leg 84 of the clamp 82 is disposed at right angles to the horizontal leg 83 and extends downwardly for engagement with the top surface of the bottom plate 12. A hole 85 is provided in the horizontal leg 83 to receive passage of one of the tie rods 18. The lock nut 21 which is threaded on the rod 18 is now adapted to abut the top surface of the clamp 82 and when the nut is drawn up tightly the horizontal leg 83 exerts a downward pressure on the plastic enclosure 73 by reason of its engagement with the annular groove 81. A plurality clamps 82 are employed around the cylindrically shaped electrolytic chamber 16 in the same manner as the clamps 28 are shown in FIG. 2.

FIG. 9 shows a further modified form of sealing the bottom of the plastic enclosure 73 to the bottom plate 12. Here the bottom plate 12 has no inset sealing ring but rather is equipped with an annular surface groove 86 to receive the lower end of the plastic cylinder 73. A cement 87, compatible with the plastic used in the plate and cylinder is applied to the joint between the plate 12 and the cylinder 73 to create a liquid tight joint for the electrolytic chamber 16. This cemented construction permits the top plate 17 to be removed for access to the plated out silver without concern for a separation between the cylindrical wall 73 and the base plate 12.

THE OPERATION OF THE DEVICE

The fixing or hypo solution of a hotographic development process is by-passed through the device of this invention when it is desired to remove silver from the hypo to rejuvenate it and make it possible to continue its further effective use in the development process. Removing silver from a hypo solution by electrolysis is not new but in all known previous devices of this type there were mechanical agitators used within the electrolysis chamber. In the device of this invention hypo is pumped into the inlet pipe 15 either by the pump used in the photographic development apparatus or by an auxiliary pump (not shown) witin the lower portion 14 of the cabinet 10. As the liquid hypo enters it is confined within the vertically disposed tubular passageway defined by the closed ended plastic tube 36. The incoming hypo does not therefore immediately contact the anode or the cathode. Rather, the liquid hypo passes outwardly of the plastic tube 36 through the plural nozzles or jet tubes 39. The relatively small volume of the combined nozzles when compared to the entire plastic tube 36 insures that the liquid will be moving at a good rate through the nozzles 39. Still further the restricted outer ends of the nozzles 39 cause the liquid hypo to be discharged therefrom in a jet action. Inasmuch as all of the restricted ends 44 of the jet tubes 39 are aimed in one direction on a circular path concentric with the anode and the cathode the hypo entering into the chamber 16 between the anode and the cathode is flowing in an uninterrupted circular movement uniformly contacting the full surfaces of the anode and the cathode at a time when an electrical potential is imposed thereacross. The hypo solution moves with a uniform velocity and is uniformly distributed within the chamber 16 and over the full surface of the cathode liner 50. This causes the maximum deposition of metallic silver onto that cathode. There are no moving parts in the present device and yet its efficiency of silver removal exceeds other mechanically agitated electrolytes. Of course, the proper electrical potential must be used to obtain maximum efficiency of the device. It has been found that the rate of silver removal should not be excessive for extended periods and hence it may be desirable for the operator to intermittently cut down on the electrical energy imposed on the system. It is important too that the discharge opening 49 be of a size substantially greater than the inlet pipe 15 in order to insure that the chamber be emptied at a faster rate than it is being filled so that the effective velocity of the incoming liquid can be maintained and that incoming liquid be distributed in a uniform fashion over the cathode. The operation as just described is the same whether the cathode of FIG. 3 or FIG. 7 is used, whether electrical contact is made to the anode and cathode by any of the modified forms shown in FIGS. 4, 5 and 7, and whether the chamber sealing means of FIGS. 3, 7, 8 or 9 are employed. When a plastic cylinder is coated with an electrical conductor and employed as the cathode it would not be necessary to effect removal of the deposited silver on the job site but rather the whole silver laden plastic cylinder could be sent out for smelting. In such instances the conductor coated plastic cylinder cathodes would be expendible and a new one inserted in the elctrolytic chamber when the filled one is removed.

We are aware that numerous details of construction may be varied throughout a wide range without departing from the principles shown herein and we therefore do not propose limiting the patent granted hereon otherwise than as necessitated by the appended claims.

What is claimed is:

1. A silver recovery apparatus comprising an electrolytic chamber having a generally liquid tight cylindrical shape disposed with its axis in a generally vertical position, said chamber having a fixed plastic bottom and a removable plastic top, an anode of a relatively small diameter cylindrical shape fixedly disposed on the general vertical center axis of and within the cylindrical electrolytic chamber, a plastic tube sealingly affixed around its circumference to said bottom and extending upwardly within said cylindrical anode, said plastic tube closed at its upper end, said closed ended plastic tube defining a vertical central passage within said electrolytic chamber, a cathode of a relatively larger diameter cylindrical shape arranged and constructed in a concentric position with and spaced outwardly from the center anode and defining the outer extent of the cylindrical electrolytic chamber, an inlet passage in the electrolytic chamber for silver contaminated hypo solution, said inlet passage communicating with the central passage in the closed ended plastic tube, a plurality of spaced apart jet tubes affixed in a generally radial position in the walls of said plastic tube, said jet tubes having their inner ends in liquid communication with the central passage in the plastic tube and their outer ends passing through the walls of the anode and extending into the space between the anode and the cathode, the outer end of each jet tube bent at substantially right angles in the same direction so that hypo solution delivered to the inlet passage will flow into the central passage within the plastic tube, thence outwardly through the jet tubes, and thence in a circular path in the concentric space around the anode and within the cathode, whereby silver freed from the hypo solution is deposited on the inner surface of the cathode to thus rejuvenate the hypo solution, and a discharge passage communicating with the electrolytic chamber between the anode and the cathode.

2. A device as set forth in claim 1 in which the cathode includes a generally cylindrically shaped removable liner with an operable joint, said removable liner being outwardly spring urged to cause it to be electrically integral with the cathode.

3. A device as set forth in claim 2 in which the openable joint of the cylindrical liner includes intercalated teeth.

4. A device as set forth in claim 1 in which the plurality of jet tubes are spaced apart both vertically and arcuately on the plastic tube and its surrounding cylindrical anode to provide for uniform distribution of the hypo solution within the electrolytic chamber in the concentric space between the anode and cathode.

5. A device as set forth in claim 4 in which the jet tubes are arranged in sets of three on each horizontal level and these jet tubes being arcuately spaced apart 120°, and the jet tubes on alternate vertical levels being similarly spaced apart 120° but being offset from the jet tubes of the intermediate levels by an arcuate 60°.

6. A device as set forth in claim 5 in which the outer ends of the jet tubes are restricted in a manner to provide for uniform vertical slits and a resulting desirable jet stream of hypo solution discharging from each of the jet tubes.

7. A device as set forth in claim 1 in which the cylindrical cathode comprises the outer enclosure of the electrolytic chamber.

8. A device as set forth in claim 1 in which the electrolytic chamber includes an outer plastic enclosure.

* * * * *